US006658771B1

(12) United States Patent
Forrest et al.

(10) Patent No.: US 6,658,771 B1
(45) Date of Patent: Dec. 9, 2003

(54) REPLACEABLE INDICIA PANEL FOR MERCHANDISING BIN

(75) Inventors: Earl D. Forrest, Asheboro, NC (US); Derrek M. Tuthill, Greensboro, NC (US)

(73) Assignee: Liberty Hardware Mfg. Corp., Winston-Salem, NC (US)

( * ) Notice: Subject to any disclaimer, the term of this patent is extended or adjusted under 35 U.S.C. 154(b) by 0 days.

(21) Appl. No.: 10/271,864

(22) Filed: Oct. 16, 2002

Related U.S. Application Data

(60) Provisional application No. 60/406,009, filed on Aug. 26, 2002.

(51) Int. Cl.[7] ..... G09F 3/00

(52) U.S. Cl. ..... 40/312; 40/666

(58) Field of Search ..... 40/124.06, 308, 40/312, 325, 666, 667; 206/459.5

(56) References Cited

U.S. PATENT DOCUMENTS

| | | | |
|---|---|---|---|
| 189,936 | A | 4/1877 | Herbert et al. |
| 264,166 | A | 9/1882 | Johnson |
| 578,913 | A | 3/1897 | Campbell |
| 925,757 | A | 6/1909 | Cuny et al. |
| 947,286 | A | 9/1910 | Thalimer |
| 1,109,114 | A | 9/1914 | Dayton |
| 1,246,364 | A | 11/1917 | Waddell |
| 1,318,306 | A | 10/1919 | Walker |
| 1,863,472 | A | 6/1932 | Covitch |
| 2,306,174 | A | 12/1942 | Mallory |
| 2,408,194 | A | 9/1946 | Bourdius |
| 2,522,028 | A | 9/1950 | Felix |
| 2,761,230 | A | 9/1956 | Finnegan |
| 2,998,128 | A | 8/1961 | Larson |
| 4,067,127 | A | 1/1978 | Klaus |
| 4,624,509 | A | 11/1986 | Ramsey |

*Primary Examiner*—Gary Hoge
(74) *Attorney, Agent, or Firm*—Edgar A. Zarins; Lloyd D. Doigan

(57) ABSTRACT

A merchandising bin for the convenient display and storage of retail goods. The merchandising bin is designed to be used in conjunction with a plurality of bins holding different parts to provide consumers a convenient choice of similar products. The bins have a front face to which a replaceable indicia panel is mounted to identify the product within the bin. The panel is received within side channels and retained on the bin face by a spring clip which resiliently engages the bin. Release of the spring clip facilitates removal and replacement of the panel as different parts are placed within the merchandising bins.

12 Claims, 4 Drawing Sheets

REPLACEABLE INDICIA PANEL FOR MERCHANDISING BIN

RELATED APPLICATIONS

This application claims priority from U.S. Provisional Application No. 60/406,009 filed on Aug. 26, 2002.

BACKGROUND OF THE INVENTION

I. Field of the Invention

This invention relates to merchandising bins for storing and displaying retail goods as part of a marketing display and, in particular, to a panel removable attached to the merchandising bin which allows convenient identification of the goods disposed within the bin.

II. Description of the Prior Art

Retailers and merchandisers have learned that one of the key factors in successfully marketing products to consumers is to catch their eye and immediately provide as much product information as possible. Consumers no longer have the patience to file through boxes sitting on shelves to find a product. Consumers prefer to scan a display of product choices and specifications to quickly locate the desired product. Such product marketing is key to increased sales.

Pull-out and tilt bins have been used to store small components. Typically, these bins are used in groups to display similar products or different product sizes. A display card or sticker may be affixed to the bin or the shelf proximate the bin. to provide detailed specifications for the product. However, such product cards can be difficult to replace or may not be easily associated by the consumer with the bin storing the part in question. Furthermore, open bins can cause product mingling when consumers simply toss a product back into the wrong bin.

SUMMARY OF THE PRESENT INVENTION

The present invention overcomes the disadvantages of the prior known merchandising bins by providing an indicia panel which is secured to the bin to clearly identify the product stored therein yet is easily removable to alter the information on the panel.

The present invention is directed to a merchandising bin forming a part of a display of numerous consumer products. Preferably the bins are open at the top to access the parts therein and tilt or pivot outwardly to allow access to the top opening. Normally, the bins form a wall display of a plurality of parts allowing consumers to scan the display to determine the desired parts. As a part is found, the bin is tilted outwardly providing access to the parts stored in the bin.

In order to quickly identify. the part stored in a particular bin, the bins of the present invention are provided with a replaceable indicia panel.. The indicia panel may be used to display specifications and illustrations for the part within the bin. The panel may also be used to display an actual sample of the part stored in the bin. Simply stated, the removable panel is used to provide sufficient information to the consumer that they can make a quick but informed decision on their product choice. However, just as pressed for time as consumers are, they are also fickle, demanding a variety of product choices. In order to allow a quick change-out of product, the display panels for the individual bins are conveniently replaceable. Just as quickly as the product can be replaced in the bins, a new panel can be attached to the merchandising bin.

The indicia panel is a planar member retained on the front face of the bin by one or more clips which lockingly engage the bin. The bin includes a front face with retaining channels spaced apart in accordance with the width of the display panel. One or more slots are formed in the front face between the channels. The slots are configured to receive the elongated retaining clips. The clips include a retaining shoulder designed to receive the bottom edge of the indicia panel and a resilient finger biasingly engageable with the slot to removable retain the spring clips within the corresponding slot.

The indicia panels are mounted to the merchandising bin by sliding the panel member into the channels which retain the side edges of the panel member. Thereafter, at least one spring clip is slid into the corresponding slot until the resilient finger enters the face of the bin and the bottom edge of the panel is received within the retaining shoulder. Removal of the indicia panel is accomplished simply by releasing the spring clips allowing the clips and the panel to be instantly removed from the face of the merchandising bin.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
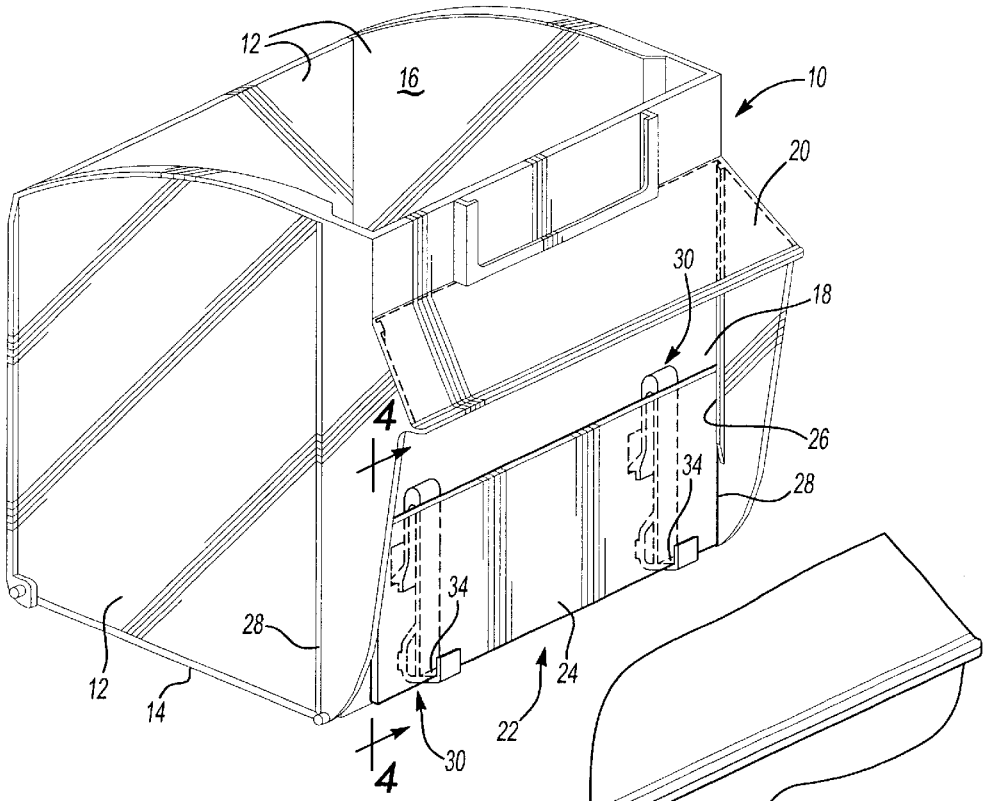
FIG. 1 is a perspective view of a selectively retractable merchandising bin embodying a replaceable indicia panel of the present invention.

Referring first to FIG. 1, there is shown an individual merchandising bin 10 forming a part of a larger merchandising display (not shown) designed to market a variety of products to consumers. The merchandising bin 10 is preferably transparent so that consumers can immediately determine the contents of each bin 10. The merchandising bins 10 are preferably arranged in rows and columns in the display allowing the consumer to quickly find the desired product. The individual bins 10 may be pulled out like drawers or tilt out to provide access to the products stored within the bin 10. In this manner, a large number of products may be displayed to the consumer within convenient access.

The merchandising bin 10 is a container having side walls 12 and a bottom wall 14 leaving an open top 16 through which merchandise is placed and removed. One of the side walls 12 forms a front face 18 displayed to the consumers. In one form of the bin 10, the front face 18 includes a handle 20 for moving the bin 10 between an open and closed position. In order to identify the product within the bin 10, the front face 18 is provided with a removable indicia display 22 in accordance with the present invention.

Referring now to all figures of the drawing, the indicia display 22 primarily comprises an indicia panel 24 removably mounted to the front face 18 of the bin 10 such that as product is changed out of the bin 10 the panel 24 can be replaced to reflect the product contained therein. The panel 24 can include specifications and illustrations for the product and may include a sample mounted to the panel 24. The front face 18 of the bin 10 includes opposing channels 26 dimensioned to slidably receive the panel 24. The channels 26 are spaced apart in accordance with the length of the panel 24 although, in a preferred embodiment, the channels 26 are formed proximate the outer edges 28 of the front face 18 such that the panel 24 extends across the face 18.

Figure 2:
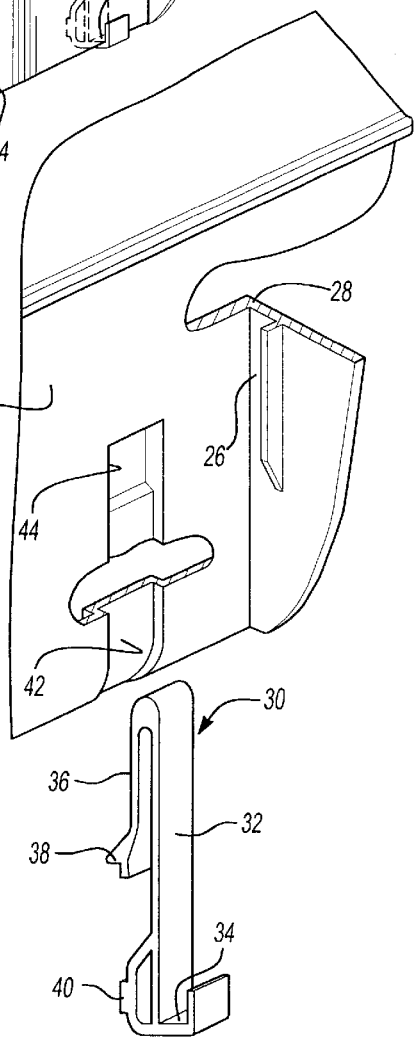
FIG. 2 is an enlarged, partial perspective view of a retaining clip engaging a front face of the merchandising bin.
Figure 3:
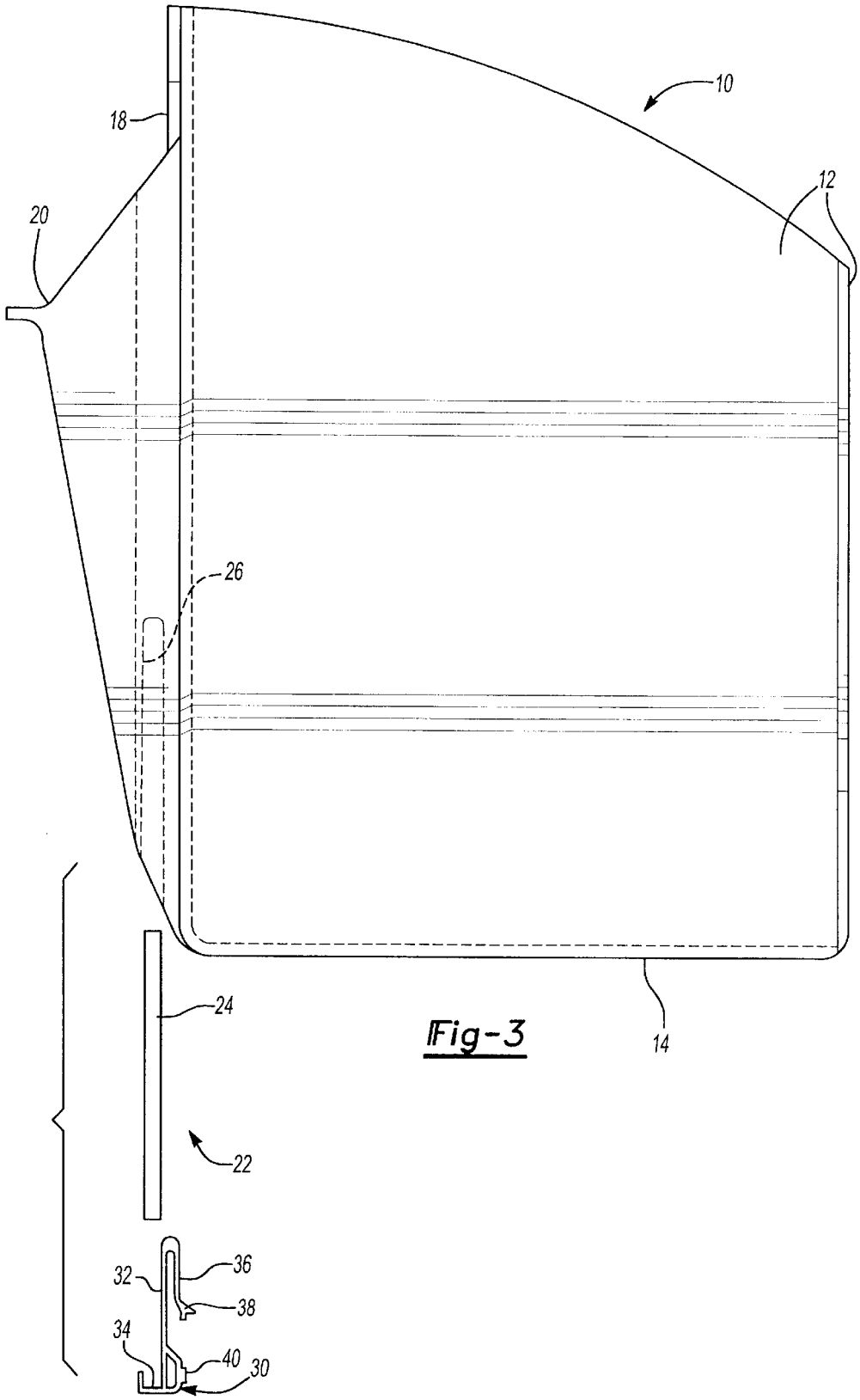
FIG. 3 is an exploded view of the merchandising bin and indicia panel.
Figure 4:
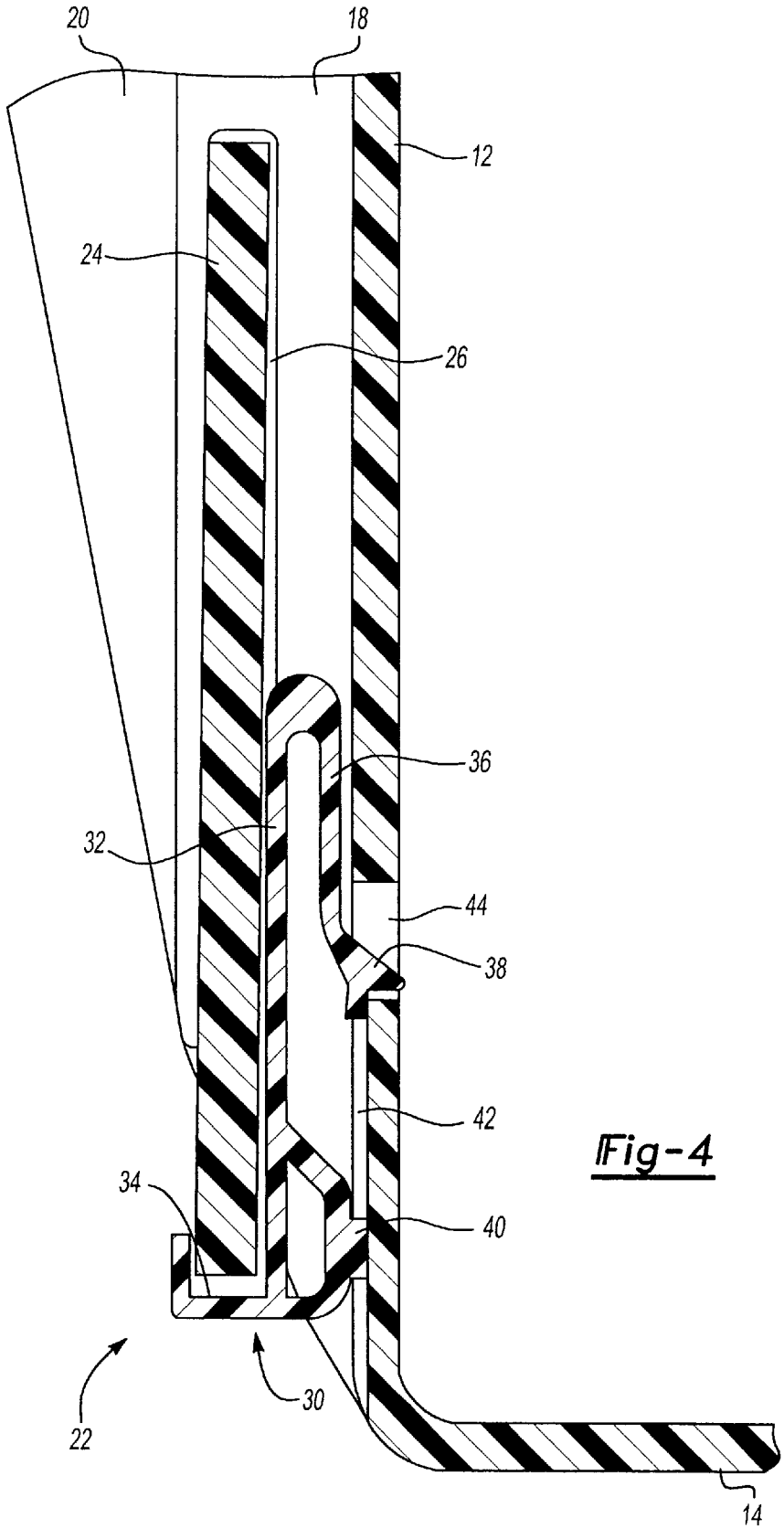
FIG. 4 is a cross-sectional view of the indicia panel seated on the front face of the merchandising bin.
Figure 5:
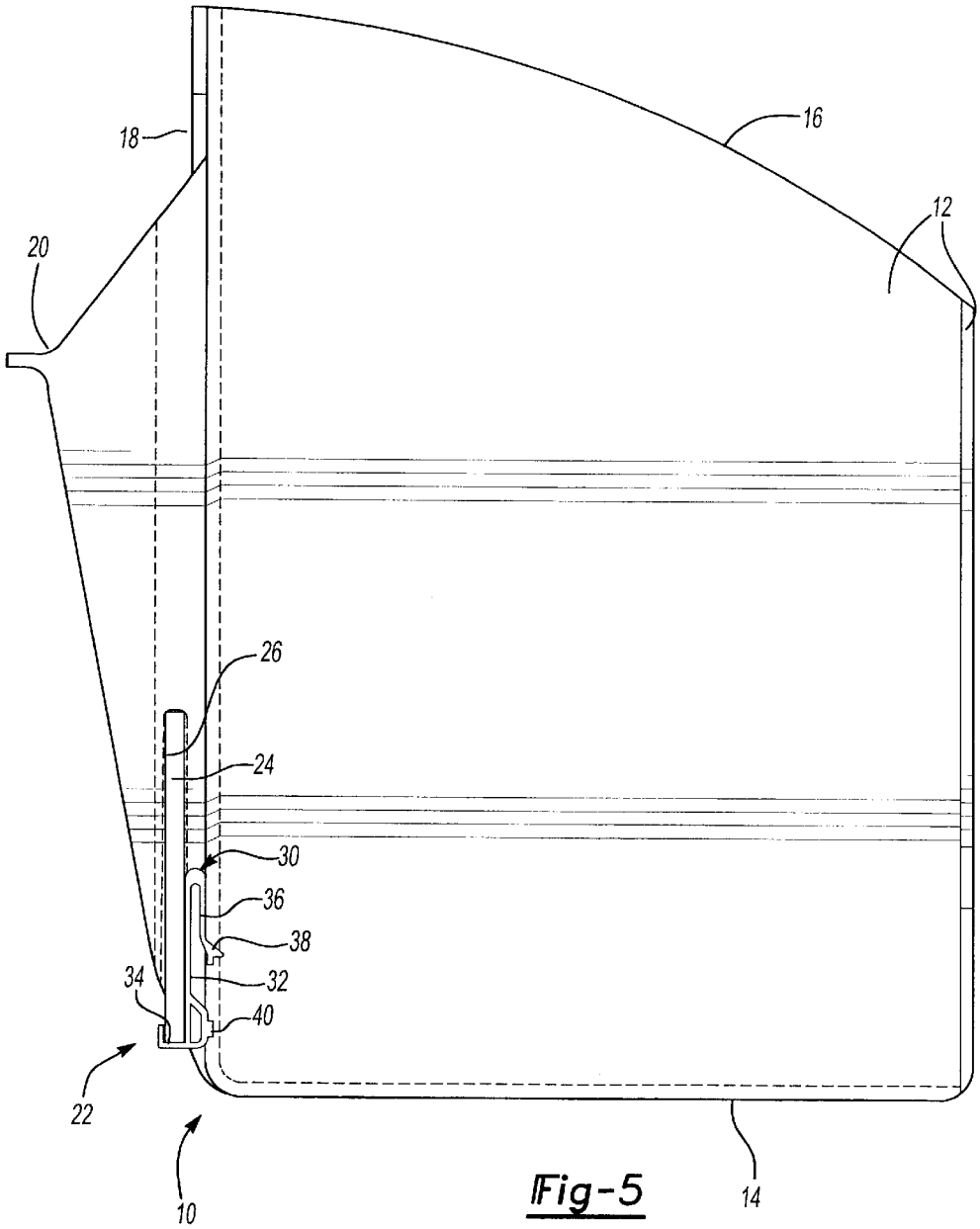
FIG. 5 is a side view of the assembled merchandising bin and indicia panel.

In order to prevent the panel 24 from inadvertently sliding out of the channels 26, retaining clips 30 designed to releasably engage the bin 10 and the panel 24 are utilized. At least one clip 30 will be used although the number of clips 30 required will be dependent upon the size of the bin 10 and panel 24. In a preferred embodiment as best shown in FIGS. 2 and 4, the clip 30 has an elongated body 32. Formed at a lower end of the body 32 is a retaining shoulder 34 configured to receive a bottom edge of the panel 24. Extending from an upper end of the body 32 is a resilient finger 36 designed to biasingly engage the bin 10. Preferably, the resilient finger 36 extends downwardly from the upper end of the body 32 and substantially parallel to the body 32. The end of the resilient finger 36 includes a locking tab 38. In order to ensure proper alignment of the clip 30 and therefore the panel 24, an abutment member 40 is formed on the body 32 opposite the retaining shoulder 34. The abutment member 40 positions the clip 30 in spaced apart relation to the bin face 18 for vertical alignment of the panel 24.

Although the retaining clips 30 may be used to simply engage the front face 18 of the bin 10, in a preferred embodiment, slots 42 are formed in the face. 18 to receive the clips 30. The slots 42 have a width corresponding to the width of the clips 30. An aperture 44 open to the interior of the bin 10 is formed within the slot 42. The aperture 44 is configured to receive the locking tab 38 of the clip 30 yet allow release of the tab 38 from the interior of the bin 10.

The retaining system for the indicia display 22 of the present invention facilitates convenient replacement of the indicia panel 24 when product is changed-out of the bin 10. The system eliminates the need to remove screws, adhesives or other fasteners typically used in the prior known labeling systems. Once a particular product is placed in the bin 10, the appropriate indicia panel 24 can be slid into the channels 26 of the front face 18. Thereafter, the retaining clips 30 are inserted into the slots 42 with the elongated body 32 behind the panel 24 until the locking tab 38 enters the aperture 44. The panel 24 will rest on the shoulder 34 of the clip 30. When removal becomes necessary, the locking tab 38 can be accessed from the interior of the bin 10 to release the resilient finger 36 and allow removal of the clip 30 from the slot 42 and removal of the panel 24. As a result, accurate specification for the product displayed in the bin 10 can be easily maintained through replacement of the indicia panel 24.

The foregoing detailed description has been given for clearness of understanding only and no unnecessary limitations should be understood therefrom as some modifications will be obvious to those skilled in the art without departing from the scope and spirit of the appended claims.

What is claimed is:

1. A merchandising bin for selectively retaining items, said bin comprising:

a storage compartment formed by a bottom wall and side walls, one of said side walls forming a front face for said merchandising bin, said front face including a pair of channels; and an indicia panel removably mounted to said front face, said indicia panel having side edges received within said channels and positionally captured on said front face by at least one removable clip.

2. The bin as defined in claim 1 wherein said at least one removable clip includes a resilient finger selectively engaging said front face to secure said at least one clip to said front face.

3. The bin as defined in claim 2 wherein said resilient finger includes a locking tab, said locking tab received within an aperture in said front face to retain said at least one clip, said locking tab accessible from the interior of said storage compartment to selectively release said locking tab from said aperture.

4. The bin as defined in claim 3 wherein said front face includes at least one slot in communication with said aperture, said at least one retaining clip selectively received in said corresponding slot.

5. The bin as defined in claim 3 wherein said at least one clip includes a retaining shoulder for receiving a bottom edge of said indicia panel.

6. In a merchandising bin for storing items having a bottom wall and side walls forming an interior storage compartment and a front face, indicia for identifying the contents of the merchandising bin, said indicia comprising:

an indicia panel removably mounted to the front face of the bin, said panel having side edges, a top edge and a bottom edge; and at least one retaining clip for retaining said indicia panel on the front face of the bin, said at least one retaining clip including an elongated body removably received within a corresponding slot formed in the front face of the bin, a retaining shoulder formed at a lower end of said elongated body to capture said bottom edge of said indicia panel, and a resilient finger extending from an upper end of said body and selectively engageable with the front face of the bin thereby capturing said indicia panel.

7. The indicia as defined in claim 6 wherein said resilient finger includes a locking tab selectively received in an aperture formed in the front face to releasably attach said at least one clip to the front face of the bin.

8. The indicia as defined in claim 7 and further comprising a pair of parallel channels formed in the front face for receiving said side edges of said indicia panel.

9. A merchandising bin for selectively retaining items, said bin comprising:

a storage compartment formed by a bottom wall and side walls, one of said side walls forming a front face for said merchandising bin; and an indicia panel removably mounted to said front face, said indicia panel positionally captured on said front face by at least one removable clip selectively engaging said front face, said at least one removable clip includes a resilient finger having a locking tab received within an aperture in said front face to retain said at least one clip, said locking tab accessible from the interior of said storage compartment to selectively release said locking tab from said aperture.

10. The bin as defined in claim 9 wherein said front face includes opposing channels for receiving side edges of said indicia panel.

11. The bin as defined in claim 9 wherein said front face includes at least one slot in communication with said aperture, said at least one retaining clip selectively received in said corresponding slot.

12. The bin as defined in claim 11 wherein said at least one clip includes a retaining shoulder for receiving a bottom edge of said indicia panel.

* * * * *